US007604550B1

(12) United States Patent
Currie

(10) Patent No.: US 7,604,550 B1
(45) Date of Patent: Oct. 20, 2009

(54) SAND WEDGE WITH AN INTERCHANGEABLE FACEPLATE

(76) Inventor: Marvin Kirk Currie, 1518 Helen Dr., Spring, TX (US) 77386

( * ) Notice: Subject to any disclaimer, the term of this patent is extended or adjusted under 35 U.S.C. 154(b) by 0 days.

(21) Appl. No.: 11/954,570

(22) Filed: Dec. 12, 2007

Related U.S. Application Data

(60) Provisional application No. 60/874,118, filed on Dec. 12, 2006.

(51) Int. Cl.
*A63B 53/04* (2006.01)

(52) U.S. Cl. ..... 473/342

(58) Field of Classification Search ..... 473/342
See application file for complete search history.

(56) References Cited

U.S. PATENT DOCUMENTS 4,618,149 A 10/1986 Maxel
4,884,808 A 12/1989 Retzer
5,437,447 A 8/1995 Rigutto
5,509,660 A * 4/1996 Elmer ..... 473/288
D399,276 S 10/1998 Hettinger et al.
2004/0009829 A1* 1/2004 Kapilow ..... 473/342
2004/0266548 A1* 12/2004 Cheng et al. ..... 473/342
2008/0004131 A1* 1/2008 Lin et al. ..... 473/342

* cited by examiner

*Primary Examiner*—Stephen L. Blau
(74) *Attorney, Agent, or Firm*—Egbert Law Offices PLLC

(57) ABSTRACT

The present invention relates to sand wedge golf club, including an elongated shaft, a metal club head, a face plate, and an attachment mechanism. The club head has a wedge body and a hosel. The wedge body has a generally U-shaped frame with a planar front face and a back face. The U-shaped frame forms a cavity on the front face of the wedge body. The faceplate includes a contact surface and a mounting surface engaging the cavity and having female connectors. The contact surface is co-planar with the front face of the wedge body and has a plurality of grooves. The attachment mechanism extends through the U-shaped frame to connect the female connectors to the wedge body.

20 Claims, 6 Drawing Sheets

SAND WEDGE WITH AN INTERCHANGEABLE FACEPLATE

CROSS-REFERENCE TO RELATED APPLICATIONS

The present application claims priority from U.S. Provisional Application Ser. No. 60/874,118, filed on Dec. 12, 2006, and entitled "Interchangeable Face Sand Wedge".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a golf club. More particularly, the present invention relates to a sand wedge golf club, which is used to strike a golf ball in a sand trap or bunker.

2. Description of Related Art Including Information Disclosed Under 37 CFR 1.97 and 37 CFR 1.98.

The sand wedge is a specialized golf club for particular application in hitting golf shots with quick loft and controlled spin. The sand wedge is commonly used to chop out of tall grass or rough, in addition to hitting a golf ball from a sand-filled bunker. The club head of the sand wedge has a particularly pitched surface and uneven shape to achieve the desired ball flight and ball rotation after contact. The club head of a sand wedge also has a rounded bottom. The distribution of weight and this shape provides more bounce for the golf club head of a sand wedge. The golf club head of a sand wedge bounces off the ground rather than digging into the ground. These considerations make the sand wedge ideal for hitting from the unstable sand surface to provide more control and accuracy for the golfer hitting out of a sand trap. Because of the frequency of use of the sand wedge in physical and environmental conditions unlike other parts of a golf course, the sand wedge is especially vulnerable to degradation of the club head. Regular golf clubs do not create the loft and spin of the sand wedge, and they are not subject to shortened life span and wear and tear of sandy conditions.

All golf clubs have a surface to contact the golf ball. This surface typically has a plurality of grooves. The grooves are important because the golfer can control the flight of the golf ball in the air. The grooves dig into the golf ball causing spin. The spinning motion allows the golfer to control the flight path of the golf ball and the rolling action after landing on the ground. For example, backspin can be used to cause the golf ball to contact the green and stick in place. As the grooves on the surface become dull, the golf ball will not rotate as fast. As the grooves are worn, the ability to spin is not controlled by the golfer. A golfer will have to replace the entire golf club when the grooves are no longer effective or no longer predictable.

The issue of replacement of grooves is especially important for a sand wedge. The sand wedge is primarily used in a sandy environment, which intensifies the erosion of the grooves. Repeated use in a sandy environment decreases the life span of a sand wedge more quickly than the normal wear and tear on the regular golf clubs. Furthermore, the material composition of the grooves is important. The contact surface for the golf ball can be made of harder or softer metals. Because of the physical properties of the metal selected, softer materials create better feel for the golfer; however, the softer materials also degrade faster. Replacement of the grooves and the contact surface of the club head are important considerations for maintaining the consistency of flight, spin, and feel.

In the past, inventions have addressed the problem of replacing grooves on a golf club without having to replace the entire golf club. Typically, the golf club head has a removable and replaceable plate. This plate has a plurality of grooves. As the grooves are worn, the plate can be replaced with a new plate with new grooves. Several patents have issued to address the problem of replacing grooves.

U.S. Pat. No. 5,437,447, issued on Aug. 1, 1995, to Rigutto, discloses a golf club putter. A face piece attached to a front portion of the body of the golf club putter. Each face piece removably attached to the golf club putter body. Each face piece can be different. Each face piece can have a different pitch to cause a different angle of contact onto the golf ball.

U.S. Pat. No. 5,509,660, issued on Apr. 23, 1996, to Elmer, teaches another golf club head. There are two body parts to this golf club head. The first body part is a flat plate which is used to contact the golfball. The second body part is a weighted frame that forms the rear side of the golf club head. The two body parts are connected together by screws, and form a golf club head with an interchangeable face. The screws or rivets pass through a front surface of the first body and connect to the second body part.

U.S. Pat. No. 4,618,149, issued on Oct. 21, 1986, to R. Maxel, teaches another golf club having interchangeable face plates. Each face plate has a planar back surface for attachment to the golf club head body. The front face of each face plate contains a surface for contacting the golf ball. This front face can have different characteristics, such as curvature and grooves, to affect the flight of the golf ball when in contact. Screws are attached through the front face of each face plate to the golf club head body. This invention is directed toward a particular golf club, specifically a fairway wood.

U.S. Pat. No. 4,884,808, issued on Dec. 5, 1989, to Retzer, teaches another golf club having exchangeable face plates. The club head of this invention has a face portion, a toe portion, and a heel portion. The face plate has a plurality of shafts extending from a back surface thereof. The shafts of the face plate fit into a series of holes on the face portion of the golf club head. Once the face plate is inserted into the series of holes, a screw is inserted through the bottom of the club head. The screw engages the shaft of the face plate in a transverse manner in order to secure the face plate to the club head body.

U.S. Design Pat. No. D399,276, issued on Oct. 6, 1998, to Hettinger et al., illustrates a golf club head having a face insert. This design discloses a golf club head with a planar front face and a curved back surface. The description of the design includes a reference to a removable face plate. However, the design figures do not illustrate how the face plate is attached to the golf club head.

It is an object of the present invention to provide a sand wedge golf club with an interchangeable face plate.

It is another object of the present invention to provide a sand wedge with easily removable and replaceable grooves on a faceplate.

It is an object of the present invention to provide a face plate formed of a first material composition and a club head with a second composition, wherein the first composition and the second composition are different.

It is an object of the present invention to provide a face plate with a unitary and planar front face.

It is still another object of the present invention to provide an attachment means for secure attachment to the golf club head without affecting the contact surface of the faceplate.

It is a further object of the present invention to reduce manufacturing costs and time to make a sand wedge and faceplate without affecting quality of the golf club.

These and other objects and advantages of the present invention will become apparent from a reading of the attached specification and appended claims.

BRIEF SUMMARY OF THE INVENTION

The present invention relates to sand wedge golf club, including an elongated shaft. There is a metal club head comprising a wedge body and a hosel. The hosel is secured to the elongated shaft. The wedge body has a generally U-shaped frame with a front face and a back face. The front face is planar. The U-shaped frame forms a cavity on the front face of the wedge body. The present invention also includes a faceplate having a contact surface and a mounting surface. The mounting surface engages the cavity and has female connecting means on a periphery. The contact surface is co-planar with the front face of the wedge body and has a plurality of grooves. An attachment means removably attaches the female connecting means on the mounting surface of the faceplate to the wedge body. The attachment means extends through the U-shaped frame. The cavity is comprised of an indentation with a plurality of tiers, forming a shoulder ledge and a stop ledge. The stop ledge has a plurality of holes aligned with the female connecting means on the mounting surface. The attachment means extends through the holes of the stop ledge into the female connecting means on the face plate.

DETAILED DESCRIPTION OF THE INVENTION

Figure 1:
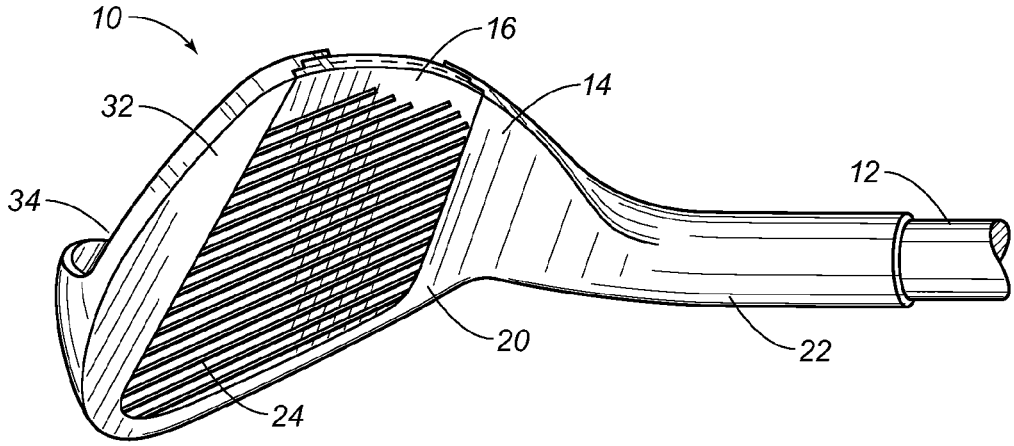
FIG. 1 is a perspective view of the sand wedge golf club of the present invention.
Figure 2:
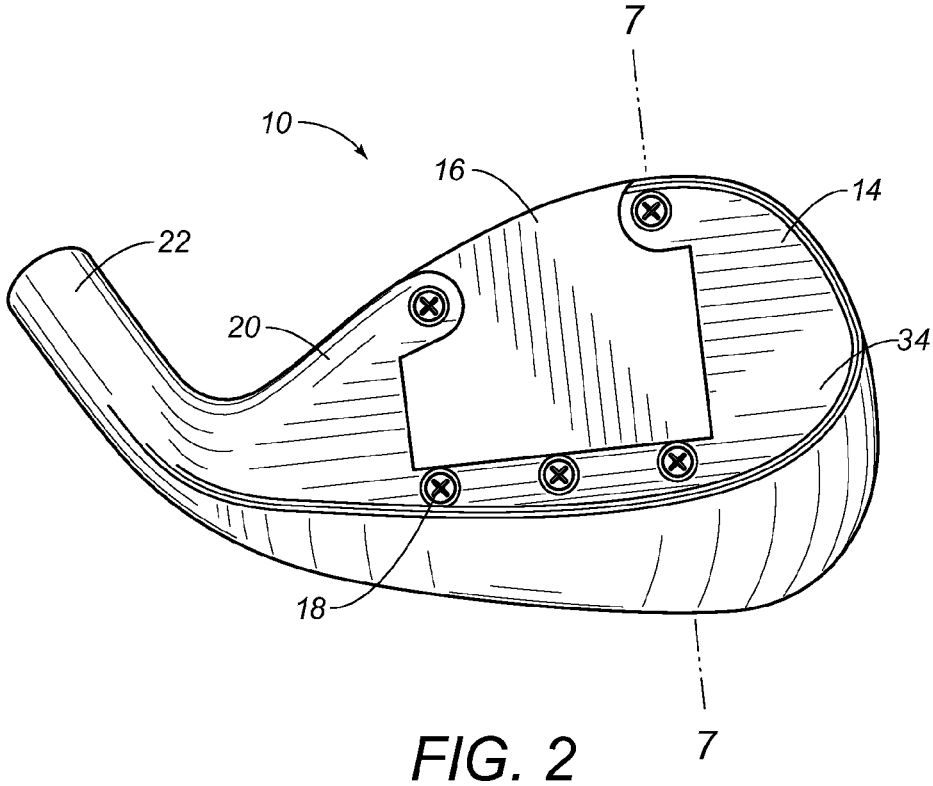
FIG. 2 is a back view of the sand wedge golf club of the present invention.
Figure 3:
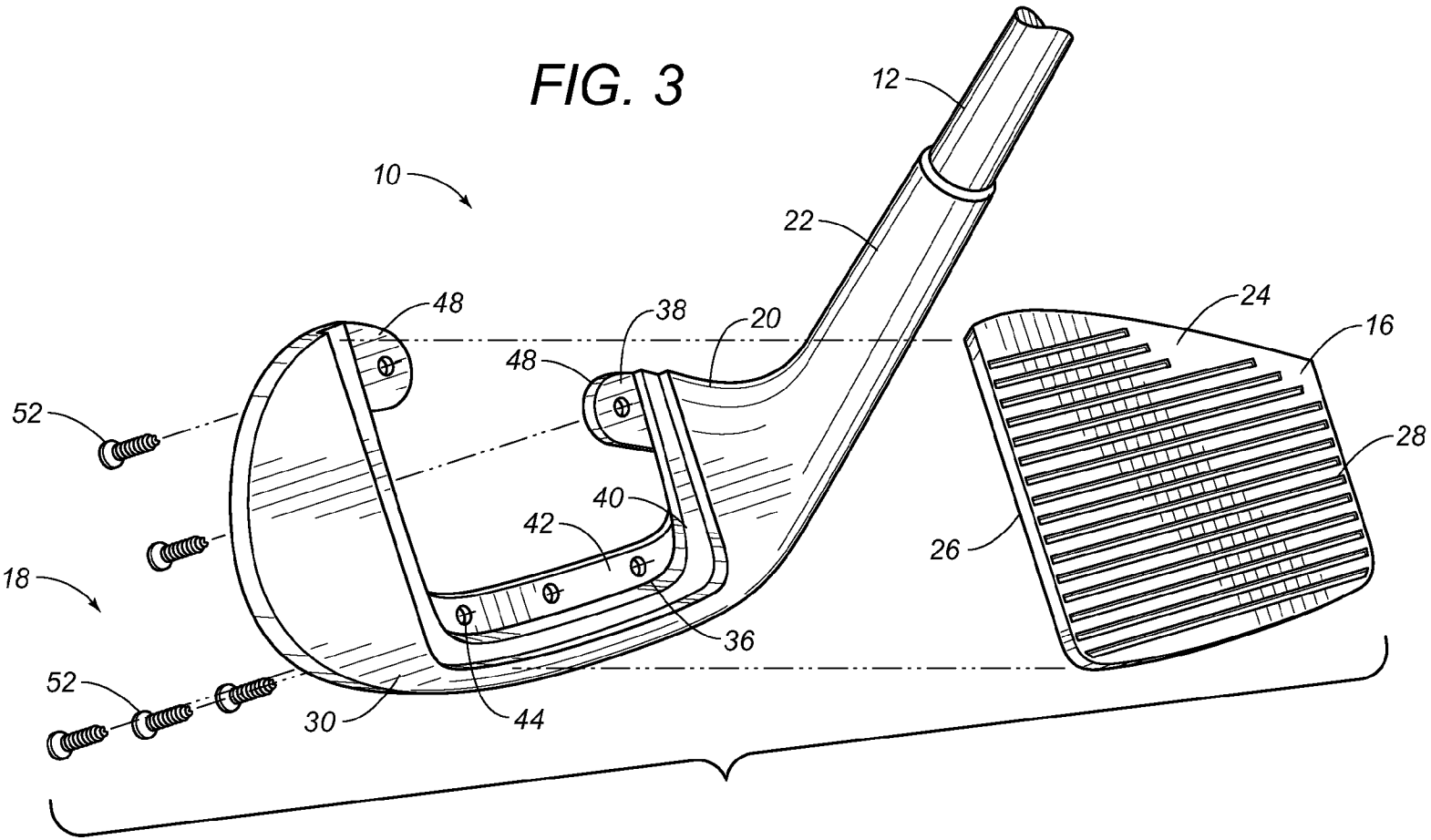
FIG. 3 is an exploded perspective view of the sand wedge golf club of the present invention.

Referring to FIGS. 1-3, the present invention is shown as a sand wedge golf club 10 comprising an elongated shaft 12, a metal club head 14, a faceplate 16, and an attachment means 18. The elongated shaft 12 has one end for connection to the metal club head 14 and another end (not shown) for a grip for use by the golfer. The metal club head 14 includes a wedge body 20 and a hosel 22. The hosel 22 is secured to the elongated shaft 12 at the one end of the shaft 12. The faceplate 16 has a contact surface 24 and amounting surface 26. The contact surface 24 is co-planar with the wedge body 20 and has a plurality of grooves 28. These grooves 28 contact the golf ball during the golf swing. The attachment means 18 extends through the metal club head 14 and into the mounting surface 26 of the face plate 16.

The wedge body 20 has a generally U-shaped frame 30 with a front face 32 and a back face 34. The front face 32 is planar and aligns or is flush with the contact surface 24 of the faceplate 16. The back face 34 has a shape with a bulged lower end, forming a distinctive sand wedge bottom and weight distribution. The rounded and heavier bottom end provides the desired bounce effect of the sand wedge 10 during contact against sand.

The U-shaped frame 30 forms a cavity 36 on the front face 32. The cavity 36 houses the faceplate 16 such that the entire volume of the faceplate 16 fits within the cavity 36. The mounting surface 26 engages the cavity 36, and the contact surface 24 becomes flush with the front face 32 along the U-shaped frame 30. The cavity 36 is an indentation with a plurality of tiers 38. The tiers 38 forms a shoulder ledge 40 and a stop ledge 42 to prevent the faceplate 16 from falling through the U-shaped frame 30. The shoulder ledge 40 and stop ledge 42 support the faceplate 16 against contact with the golfball during the golf swing. The shoulder ledge 40 is flush against the mounting surface 26.

The stop ledge 42 has a plurality of holes 44. The configuration of these holes 44 are shown in different embodiments at the stop ledge 42 level. FIGS. 1-3 show the stop ledge 42 with three holes 44 on a bottom 46 and two holes 44 on each of the opposite flange ends 48 of the U-shaped frame 30. The flange ends 48 are extend transverse to the ends of the U-shaped frame 30, and the holes 44 on the flange ends 48 are at the same depth as the stop ledge 42 so that the faceplate 16 remains flush with the front face 32.

Figure 4:
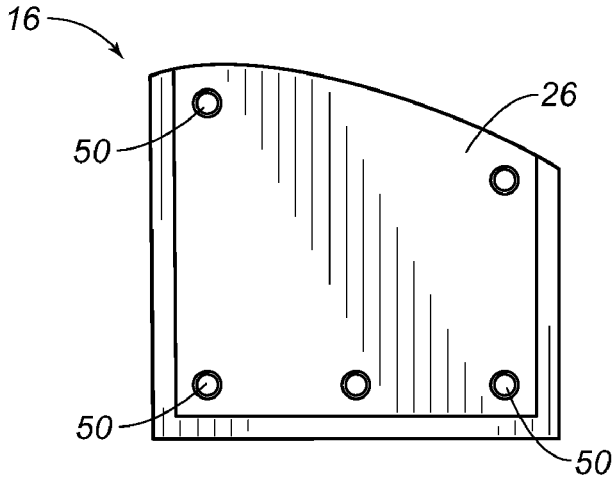
FIG. 4 is a back view of the face plate of the present invention.
Figure 7:
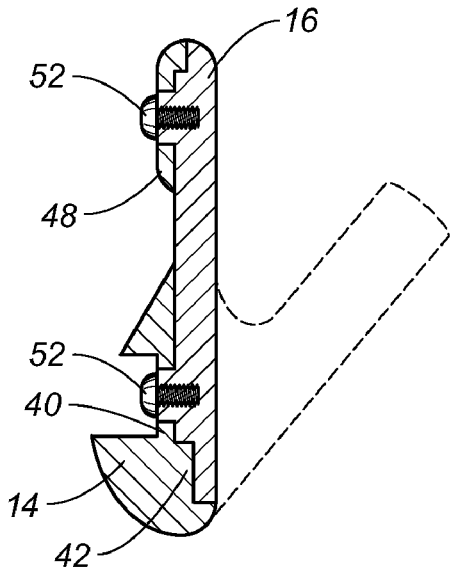
FIG. 7 is a cross sectional view of the sand wedge golf club of the present invention across line A-A in FIG. 2.

FIG. 4 shows a back view of the faceplate 16 of the present invention, showing the mounting surface 26. There are female connecting means 50 on the mounting surface 26 of the faceplate 16. The holes 44 of the wedge body 20 are aligned with the female connecting means 50. For example, FIG. 2 shows the placement of five holes 44 for the five female connecting means 50 of the faceplate 16. The flange ends 48 correspond to the top two holes 44 even though the holes 44 and female connecting means 50 are not at the same height. The female connecting means 50 are arranged along a periphery of the faceplate 16 to match the U-shaped frame 30 of the wedge body 20. The female connecting means 50 extend upwards from the mounting surface 26 such that the screws 52 engage the three bottom holes 44 on the stop ledge 42 and the two top holes 44 on the shoulder ledge 40. The holes 44 are sufficiently large for ends of the screws 52 and the female connecting means 50 to pass therethrough. FIG. 7 shows a cross-sectional view of the preferred embodiment, illustrating the alignment of the stop ledge 42 with the flanged ends 48 against the mounting surface 26. Additionally, the female connecting means 50 are placed away from the intended contact with the golf ball during the golf swing.

The faceplate 16 is comprised of a first material composition, including a metal, such as copper, brass, or stainless steel. The metal club head 14 is comprised of a second material composition, including a different metal than the faceplate 16. The different metal composition of the faceplate 16 and metal club head 14 allows the golfer to customize a particular weight and feel without purchasing an entirely new sand wedge. The first material composition of the faceplate 16 is particularly important to be interchangeable. Softer metals give the contact surface 24 better feel for the golfer. However, the softer materials degrade faster. The present invention allows the golfer to chose and maintain the softer materials and better feel for the golf club.

The attachment means 18 removably attach the female connecting means 50 on the mounting surface 26 of the faceplate 16 to the wedge body 20. The attachment means 18 are screws 52 extending through the U-shaped frame 30. The screwing attachment passes through the holes 44, such that the holes 44 of the wedge body 20 are not required to be threaded. The female connecting means 50 can be threaded to provide the secure locking of the faceplate 16 to the wedge body 20. In this manner, the faceplate 16 is removably attached to the wedge body 20. A new or different faceplate 16 can be attached to the sand wedge 10 in order to replace the grooves 28.

Figure 5:
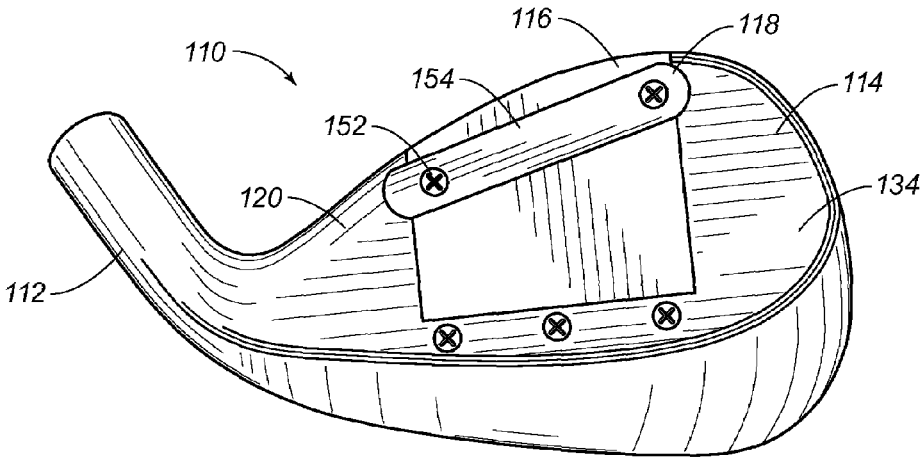
FIG. 5 is a back perspective view of an alternate embodiment of the present invention.
Figure 6:
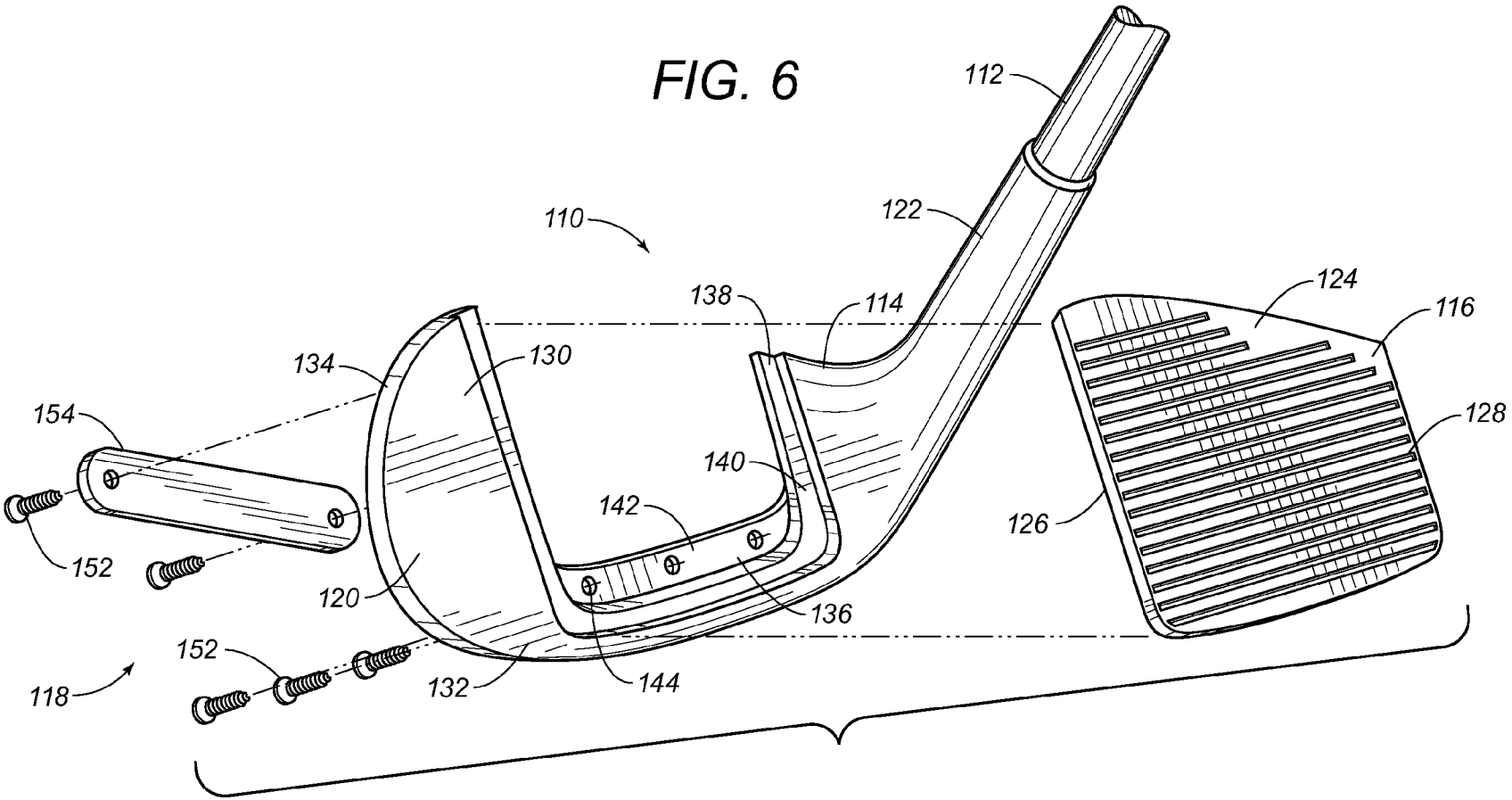
FIG. 6 is another exploded perspective view of the alternative embodiment shown in FIG. 5.

FIGS. 5-6 show an alternative embodiment of the sand wedge 110 of the present invention with an elongated shaft 112, a metal club head 114, a faceplate 116, and an attachment means 118. In this embodiment, the attachment means 118 are comprised of screws 152 and a blocking bar 154. The blocking bar 154 extends across opposite ends of the U-shaped frame 130 and having blocking holes 156 therethrough. The screws 152 extend through the blocking holes 156, instead of the holes 44 of the preferred embodiment, to engage female connecting means 150 of a mounting surface 126 of the face plate 116. The blocking bar 154 prevents displacement of the faceplate 116 from the wedge body 120. The shoulder ledge 140 is now cooperative with the screws 152 and the female connecting means 150 of the faceplate 116. The screws 152 engage the faceplate 116 to fixedly secure the mounting surface 126 of the faceplate 116 against the shoulder ledge 140, while passing through the back face 134 of the wedge body 120. This alternative embodiment of the sand wedge 110 does not have any flanged ends. The blocking bar 154 and mounting surface 126 sandwich the wedge body 120 for the locked position of the faceplate 116. The blocking bar 154 can also be permanently secured to the back face 134 of the metal club head 114.

Figure 8:
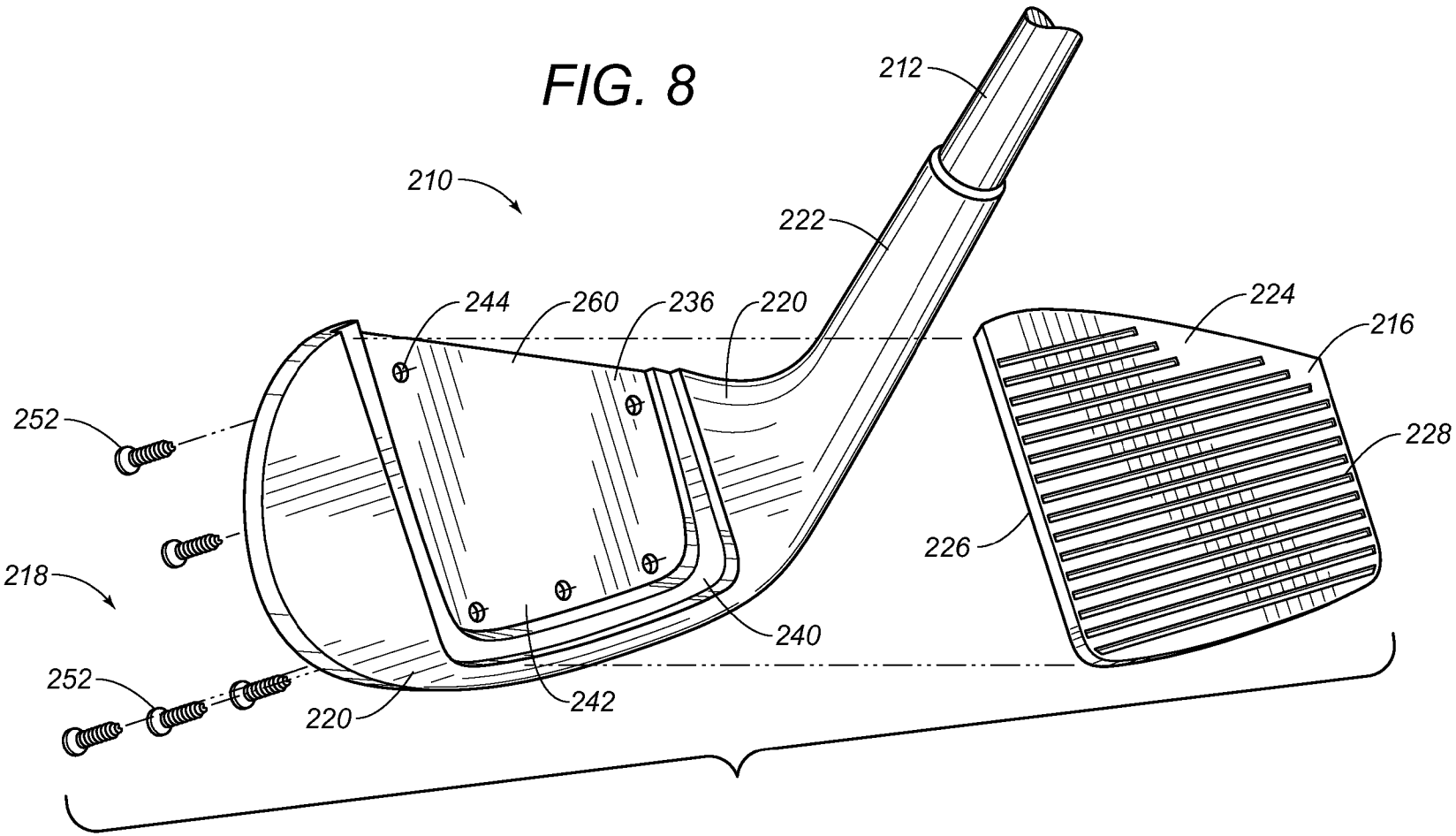
FIG. 8 is an exploded perspective view of another alternative embodiment of the present invention.

FIG. 8 shows another alternative embodiment of the sand wedge 210 of the present invention. This embodiment similarly includes an elongated shaft 212, a metal club head 214, a faceplate 216, and an attachment means 218. Importantly, the attachment means 218 are screws 252 engaging the female connecting means 250 through the stop ledge 242. There is no U-shaped frame because a full backing 260 at the depth of the stop ledge 242 is formed across the entire wedge body 220. The screws 252 lock the faceplate 216 through the female connecting means 250 directly through the holes 244 without any exposure of the mounting surface 262 to the back face 234 of the wedge body 220. The backing 260 and the mounting surface 226 sandwich the shoulder ledge 240 of the wedge body 220 for secure fastening of the faceplate 216.

The sand wedge of the present invention provides an innovative sand wedge golf club with an interchangeable face plate. The grooves are easily removable and replaceable in order to allow a golfer to better control and more consistently strike a golf ball from a sand trap. The entire sand wedge does not have to be replaced even with frequent use and exposure to sand and erosion conditions. The face plate is also easily removable and replaceable in order to allow adjustment of the contact surface. A faceplate with a different metal composition than the metal club head can adjust the weight and balance of the club. A faceplate with a softer metal composition can be easily replaced and renewed for maintaining the consistency of the feel of the sand wedge. The innovative attachment means maintains a faceplate with a unitary surface that is uninterrupted by screwheads or other distortions on the contact surface for the golf ball. The planar front face of the wedge body and the contact surface of the faceplate are not affected by the secure attachment of these removably fastened parts of the sand wedge.

The separation of the metal club head and the faceplate also reduces manufacturing costs and time to make a sand wedge and faceplate without affecting quality of the golf club. The faceplates can be formed of different materials, independent from the metal club head. The grooves can be scored onto the contact surface of a flat faceplate without requiring special equipment to account for the odd angles and back surfaces of the metal club head. The machining of the faceplate can be accomplished faster than working with alignment and mounting of the entire metal club head to reduce manufacturing time.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A sand wedge golf club comprising:

an elongated shaft;

a metal club head comprising a wedge body and a hosel, said hosel being secured to said elongated shaft, said wedge body having a generally U-shaped frame with a front face and a back face between a toe and a heel, said front face being planar at a toe portion, the frame forming a cavity on said front face, wherein said U-shaped frame is viewed from in front of said front face;

a faceplate having a contact surface and a mounting surface, said mounting surface engaging said cavity and having female connecting means on a periphery thereof, said contact surface being co-planar with said front face at a toe portion of said wedge body, said contact surface having a plurality of grooves; and attachment means removably attaching said female connecting means on said mounting surface of said faceplate to said wedge body, said attachment means extending through said frame.

2. The sand wedge golf club, according to claim 1, wherein said back face has a shape with a bulged lower end.

3. The sand wedge golf club, according to claim 1, wherein said cavity is comprised of an indentation with a plurality of tiers, said tiers forming a shoulder ledge and a stop ledge.

4. The sand wedge golf club, according to claim 3, wherein said stop ledge has a plurality of holes therethrough, said holes being aligned with said female connecting means.

5. The sand wedge golf club, according to claim 3, wherein said stop ledge has flanges extending transverse to ends of the U-shaped frame.

6. The sand wedge golf club, according to claim 5, wherein said flanges have holes being aligned with said female connecting means of said mounting face.

7. The sand wedge golf club, according to claim 1, wherein said attachment means is comprised of screws.

8. The sand wedge golf club, according to claim 1, wherein said attachment means is comprised of screws and a blocking bar, said blocking bar extending across opposite ends of the U-shaped frame and having blocking holes therethrough, said screws extending through said blocking holes to engage said female connecting means of said mounting surface of said face plate.

9. The sand wedge golf club, according to claim 8, wherein said blocking bar is fixedly attached to said back face of said wedge body at ends thereof, said blocking bar extending across opposite ends of the U-shaped frame.

10. The sand wedge golf club, according to claim 1, wherein said face plate is comprised of a first material composition, said metal club head being comprised of a second material composition, said first material composition and said second material composition being different.

11. A sand wedge golf club comprising:

an elongated shaft;

a metal club head comprising a wedge body and a hosel, said hosel being secured to said elongated shaft, said wedge body having a generally U-shaped frame with a front face and a back face between a toe and a heel, said front face being planar at a toe portion, the frame forming a cavity on said front face, wherein said U-shaped frame is viewed from in front of said front face, said cavity being an indentation with a plurality of tiers, said tiers forming a shoulder ledge and a stop ledge, said stop ledge having a plurality of holes;

a faceplate having a contact surface and a mounting surface, said mounting surface engaging said cavity and having female connecting means on a periphery thereof, said female connecting means positioned to align with said holes of said stop ledge, said contact surface being flush with said front face at a toe portion of said wedge body, said contact surface having a plurality of grooves; and attachment means removably attaching said female connecting means on said mounting surface of said faceplate to said wedge body, said attachment means extending through said frame.

12. The sand wedge golf club, according to claim 11, wherein said back face has a shape with a bulged lower end.

13. The sand wedge golf club, according to claim 11, wherein said attachment means is comprised of screws.

14. The sand wedge golf club, according to claim 11, wherein said attachment means is comprised of screws and a blocking bar, said blocking bar extending across opposite ends of the U-shaped frame and having blocking holes therethrough, said screws extending through said blocking holes to engage said female connecting means of said mounting surface of said face plate.

15. The sand wedge golf club, according to claim 11, wherein said blocking bar is fixedly attached to said back face of said wedge body at ends thereof, said blocking bar extending across opposite ends of the U-shaped frame.

16. The sand wedge golf club, according to claim 11, wherein said face plate is comprised of a first material composition, said metal club head being comprised of a second material composition, said first material composition and said second material composition being different.

17. A sand wedge golf club comprising:

an elongated shaft;

a metal club head comprising a wedge body and a hosel, said hosel being secured to said elongated shaft, said wedge body having a generally U-shaped frame with a front face and a back face between a toe and a heel, said front face being planar at a toe portion and forming a cavity therein with a plurality of planar tiers, said planar tiers being a shoulder ledge and a stop ledge, said stop ledge being a backing and having a plurality of holes wherein said U-shaped frame is viewed from in front of said front face;

a faceplate having a contact surface and a mounting surface, said mounting surface engaging said cavity and having female connecting means on a periphery thereof, said female connecting means positioned to align with said holes of said stop ledge, said mounting surface having a rim fitted to said shoulder ledge of said cavity, said contact surface being co-planar with said front face at a toe portion of said wedge body, said contact surface having a plurality of grooves; and attachment means removably attaching said female connecting means on said mounting surface of said faceplate to said wedge body, said attachment means extending through said back face and then said front face of said wedge body.

18. The sand wedge golf club, according to claim 17, wherein said back face has a shape with a bulged lower end.

19. The sand wedge golf club, according to claim 17, wherein said attachment means is comprised of screws, said screws extending through said holes and engaging said female connecting means of said mounting surface of said face plate.

20. The sand wedge golf club, according to claim 17, wherein said face plate is comprised of a first material composition, said metal club head being comprised of a second material composition, said first material composition and said second material composition being different.

* * * * *